United States Patent [19]

Balsavage

[11] Patent Number: 4,524,672

[45] Date of Patent: Jun. 25, 1985

[54] MAGAZINE AND FEED MECHANISM FOR FIREARMS

[76] Inventor: Walter Balsavage, 222 Tantum Dr., Trenton, N.J. 08610

[21] Appl. No.: 489,280

[22] Filed: Apr. 27, 1983

[51] Int. Cl.[3] ..... F41C 25/04

[52] U.S. Cl. ..... 89/33.1; 89/34

[58] Field of Search ..... 89/33.1, 33 B, 33.17, 89/33 BA, 34

[56] References Cited

U.S. PATENT DOCUMENTS

| | | | |
|---|---|---|---|
| 1,218,458 | 3/1917 | Polite | 42/11 |
| 1,322,053 | 11/1919 | Reising | 42/17 |
| 2,358,792 | 9/1944 | Conway | 42/17 |
| 2,359,517 | 10/1944 | Gebeau | 42/17 |
| 2,448,081 | 8/1948 | Conway | 42/17 |
| 2,624,241 | 1/1953 | Hill | 89/33.17 |
| 2,773,325 | 12/1956 | Hill | 42/50 |
| 2,791,855 | 5/1957 | Simmons | 42/17 |
| 2,882,635 | 4/1959 | Hill | 42/17 |
| 3,125,821 | 3/1964 | Ruger et al. | 42/17 |
| 3,142,921 | 8/1964 | Ruger | 42/17 |
| 4,152,857 | 5/1979 | Ketterer | 42/50 |
| 4,286,499 | 9/1981 | Gillum | 42/50 |
| 4,336,742 | 6/1982 | Bourlet | 42/50 |

FOREIGN PATENT DOCUMENTS

| | | | |
|---|---|---|---|
| 573658 | 11/1945 | United Kingdom | 89/33 BA |

*Primary Examiner*—Stephen C. Bentley

*Attorney, Agent, or Firm*—Sperry, Zoda & Kane

[57] ABSTRACT

A magazine, from which cartridges are cross-fed to a transfer disc which is rotated to align each cartridge with the barrel of a firearm, is provided at its discharge end with a spring-hinged restraining flap that normally engages the leading cartridge against passage to the transfer disc. The flap is slotted so that injector fingers, normally spring-biased to a retracted position, may enter the magazine to bias the leading cartridge into the transfer disc. An actuating arm for the transfer disc, when advanced, rotates the disc to align with the barrel the cartridge deposited therein by the injector elements. When the actuating arm is advanced, the injector elements are left free to be spring-biased to their retracted positions. When the actuating arm is retracted, a cam finger carried by the arm is affective to move the injector element through the slots in the flap to shift the next following cartridge past the flap into the transfer disc.

19 Claims, 5 Drawing Figures

MAGAZINE AND FEED MECHANISM FOR FIREARMS

BACKGROUND OF THE INVENTION

The present invention relates generally to firearms, in particular those from which cartridges are fed from a magazine while being disposed transversely to the axis of the barrel of the weapon, and are thereafter turned through 90° to positions in which they are aligned with the bore, ready for firing.

The present invention is an improvement in a mechanism for cross-feeding cartridges in weapons of this particular type. In the invention, the magazine extends parallel to the barrel of the weapon, being disposed forwardly of the breech, the rearwardly disposed end of the magazine being open for the purpose of feeding the cartridges.

Guns have been designed with magazines in which the cartridges are arranged transversely of the barrel, and are fed from the magazine, one at a time, into rotatable transfer discs, which are then turned through 90° to align the cartridges longitudinally with the bore of the weapon. This is shown, for example, in U.S. Pat. Nos. 2,624,241 and 2,773,325, both issued to Hill.

Patents such as those identified above have represented a substantial improvement in firearms design, but nevertheless, have certain deficiencies. In the Hill patents, the design of the weapons there disclosed is such as to raise the possibility of creating dangerous conditions, in that the feed mechanisms disclosed in the patents permit a round to be left inside the feed mechanism without the knowledge of the user.

In the above-designated Hill patents, an important object was to provide a more compact weapon, by positioning a magazine along the receiver parallel to the longitudinal axis of the firearm. This arrangement provided a better balanced weapon and made it possible to operate the gun at close proximity to the ground or to a shooting obstacle at the side of the user, as distinguished from prior art weapons in which the magazine frequently projected downwardly, or laterally from the receiver.

In accordance with the present invention, an improved, safer feeding mechanism for transferring cartridges from the magazine to the breech of the firearm is combined with extension of the magazine forwardly from the breech, rather than rearwardly therefrom as in the case of the Hill patents. In this way, an even more compact firearm is provided, having all the advantages of the Hill firearm, while additionally building into the weapon a design capability for even greater compactness in length, in that the magazine and barrel may be substantially co-extensive, whereas in the Hill patent the barrel would extend forwardly from the breech and the magazine rearwardly therefrom, so that the firearm would of necessity have to be of a length at least equal to the length of the barrel plus the length of the magazine.

It has been heretofore proposed, it may be noted, to provide magazines that will extend parallel to and along the length of the barrel, that is, forwardly from the breech. However, so far as is known, none of these has embodied in a rear feeding magazine an improved feed mechanism, which will cross-feed the rounds safely and surely with minimum possibility of malfunction, into a rotatable transfer disc of the type disclosed in the above-mentioned Hill patents. An important object of the present invention is to provide a firearm that will accomplish this desirable result.

To accomplish the above stated objects, and eliminate the deficiencies of the prior art firearms, my magazine and feed mechanism, summarized briefly, includes a magazine that extends parallel to and in longitudinally contacting relation with the barrel. In accordance with the invention, the magazine is of the rear-feeding type, and cross-feeds cartridges in successively following order into the breech of the firearm, that is, the cartridges are fed into the breech while extending transversely of the barrel.

The invention incorporates a spring-hinged, curved flap on the rear end of the magazine, which imparts a change in direction to the cartridges, leading them to a position in which they are ready for passage into the receiver. The flap, at its distal end, is turned inwardly in such manner as to prevent the cartridge from being fed into the receiver under the pressure of the spring-loaded follower that is conventionally provided in magazines of the general type disclosed in this application. Rather, passage of the round into the breech occurs only when a pair of cartridge injector elements are advanced through slots in the flap, to engage the leading cartridge and against the spring tension of the flap, force the cartridge out of the magazine into a transfer disc mounted in the receiver in accordance with the disclosure of the above-mentioned Hill patents.

The advancement of the injector elements is caused by a cam action exerted against the injector element assembly, exerted by a lateral projection provided upon the actuating arm that is provided in accordance with the disclosure of the above-mentioned Hill patents, for the purpose of rotating the disc. As the arm advances to turn the transfer disc 90° to align the cartridge with the barrel, the injector elements are permitted to retract under the pressure of springs incorporated in the injector element assembly, so that the next following cartridge cannot be fed into the transfer disc. When, however, the disc-actuating arm is retracted following firing of a round, it acts to advance the injector elements so that they force the next cartridge into the transfer disc.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
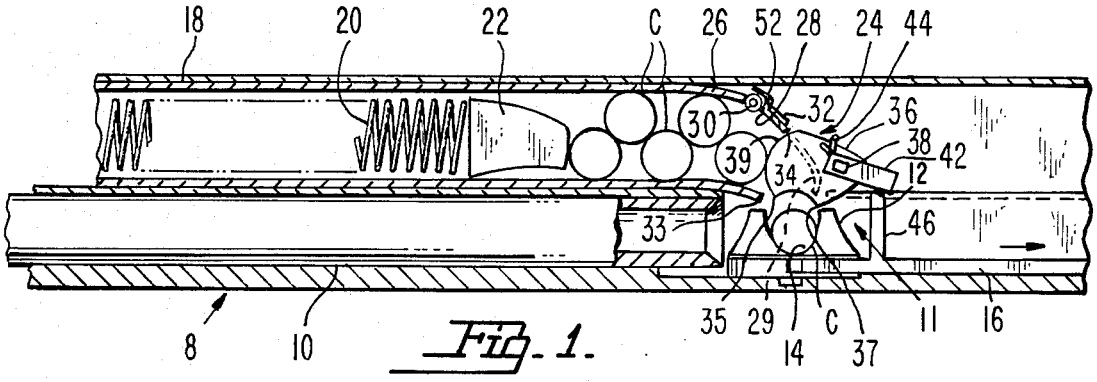
FIG. 1 is a fragmentary longitudinal section through a firearm showing a portion of the barrel, receiver, and magazine, with the feed mechanism comprising the present invention being shown in advanced position.

The invention has been shown embodied in a firearm generally designated 8, having a barrel 10 opening rearwardly into the breech 11, in which there is mounted a rotatable transfer disc 12 having a through, upwardly opening slot 14 for receiving cartridges C.

In the drawings, the invention has been illustrated in association with a cartridge-orienting assembly similar to that shown in Hill patents 2,624,241 and 2,773,325. Those patents illustrate a transfer disc like that shown at 12, which receives cartridges from the magazine while in the position shown in FIG. 1, that is, with the cartridges disposed transversely of the barrel. The Hill patents also show a transfer disc actuating arm 16, adapted to be advanced from a normally retracted position shown in FIG. 1, to the position shown in FIG. 2, in which it is operative to rotate the transfer disc 90°, to align with the barrel the cartridge C disposed in the slot 14 of the disc.

For the purposes of the present disclosure, it is deemed unnecessary to further illustrate or describe the operation of the transfer disc and the actuating mechanism 16 associated therewith. For a full understanding of this aspect of the vehicle construction and operation, reference should be had to the above-mentioned Hill patents, the disclosures of which are incorporated herein by reference.

In accordance with the invention, a magazine 18 extends forwardly from the breech 11, above and in parallel, longitudinally contacting relation with the barrel 10. The magazine 18 is provided with the usual follower spring 20, exerting a continuous force on follower 22 tending to crossfeed the cartridges C from the rear end of the magazine into the slot 14 of the transfer disc 12.

A magazine of the type illustrated would, very possibly, be of the reusable type. Thus, it could be removable, and replaced with another, identical, fully loaded magazine, so that magazines that have been emptied of their supply of cartridges, can be reloaded again and again.

Alternatively, the magazine can be of the type in which, after emptying of the magazine, the follower can be retracted, and a fresh supply of cartridges inserted in package form through a side opening, not shown, in the magazine. Such an arrangement is shown in Hill U.S. Pat. No. 2,624,241. The present invention, in other words, is not concerned with the manner in which the cartridges are loaded into the magazine, and is directed primarily to the controlled feeding of the cartridges from the magazine into the breech.

In the above-mentioned Hill patents, the feeding of the cartridges C from the magazine is controlled only by engagement of each cartridge against the transfer disc itself, as the cartridge seeks an exit from the open end of the magazine under the force of the follower. This arrangement has been found to produce certain hazards to the personal safety of the user, in that cartridges can be left inside the feed mechanism and the gun action, unseen and unknown to the user.

In accordance with the present invention, a feed mechanism generally designated 24 includes, as a rearward extension of the longitudinally inwardly curved rear end portion 26 of the top wall of the magazine, a flap 28 having a hinge connection 30 to the top wall extension 26. Torsion springs 32 are incorporated in the hinge, and exert a resilient, yielding bias against the flap 28, tending to urge the flap downwardly and inwardly to normally narrow the open rear end 33 of the magazine and in this way block passage of each cartridge C from the magazine, as it moves into a position from which it is to be fed into the breech 11.

Figure 2:
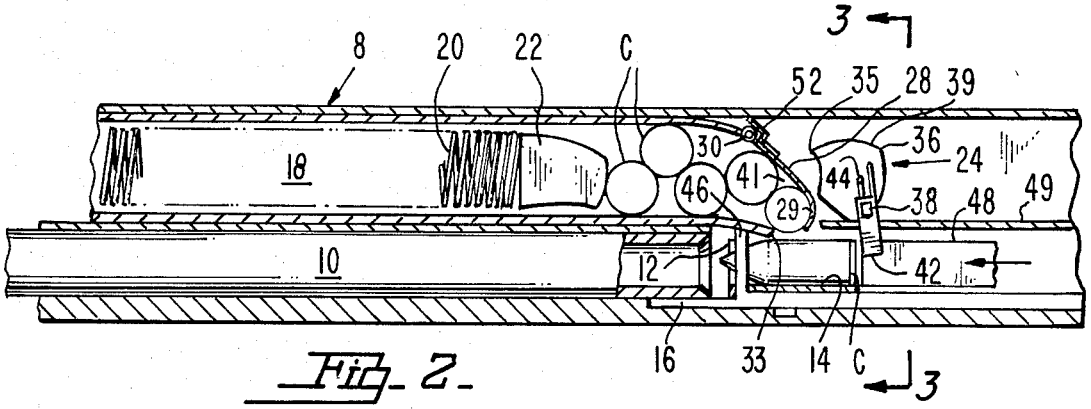
FIG. 2 is a view similar to FIG. 1 in which the feed mechanism has been retracted and the previously deposited round has been aligned longitudinally with the barrel preliminary to firing of the gun.

For the purpose of providing a positive stop for the cartridge C that is to be fed into the breech, flap 28, at its distal end, is curved inwardly as at 29, in general correspondence with the diameter of the cartridge (see FIG. 2).

The particular curvature of the distal end 29 of flap 28, in conjunction with the force of the torsion springs 32, is sufficient to prevent the spring 20 from exerting a pressure against the cartridges C that remain in the magazine, sufficient to force the flap outwardly and thereby expand the size of the feed opening 33 enough to permit passage of a cartridge past the flap. As a result, no cartridge can leave the magazine while another cartridge is in the transfer disc.

Figure 4:
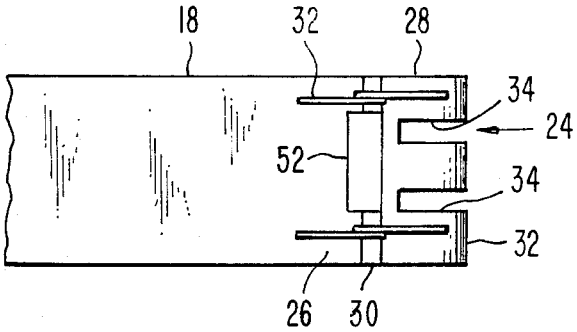
FIG. 4 is a fragmentary top plan view of the rear end of the magazine, per se.

Referring to FIG. 4, formed in the flap 28 are transversely spaced, deep clearance slots 34, 34. Slots 34 are for the purpose of permitting a pair of cartridge injector elements 36 to move from normally retracted positions shown in FIG. 2, to advanced positions shown in FIG. 1, in which they have entered the rear end of the magazine, through the clearance slots 34.

In the illustrated example, the injector elements 36 are in the form of cam plates, having inwardly curved recesses 37 in their leading ends, curved inwardly on radii approximately corresponding to those of the cartridges C. Adjacent the recesses 37, the injector elements 36 have outwardly curved cam surfaces 39. The arrangement is such that when the injector elements enter the magazine through the slots 34, and are advanced to the positions shown in FIG. 1, there are provided, at the intersection between the recesses 37 and the curved cam surfaces 39, wedge-like pointed portions 35, which will enter the correspondingly wedge-shaped space 41 (FIG. 2) defined between the cartridge that is next to be fed from the magazine and is engaged by distal end 29 of flap 28, and the next following cartridge.

By reason of this arrangement, when the injector elements enter through slots 34, the pointed portions 35 enter space 41, so as to prevent downward feeding of the cartridge next following the lead cartridge engaged against distal portion 29 of flap 28. Further advancement of the injector elements causes the cam surfaces 39 thereof to engage the next following cartridge while at the same time the lead cartridge is now engaged within recesses 37 of the injector elements. As the injector elements continue movement to their fully advanced positions, the lead cartridge is forced downwardly into the breech, with flap 28 yielding outwardly to the passage of the cartridge into the breech.

Figure 5:
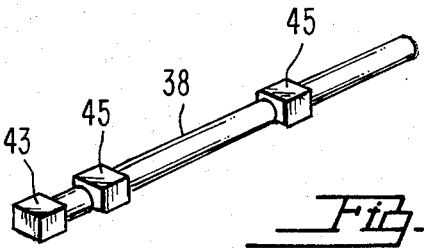
FIG. 5 is a perspective view of a support shaft for the injector elements.

The injector element assembly 24 includes, for the purpose of creating this action, a transversely disposed injector element support shaft 38 (FIGS. 3 and 5) which, in the illustrated embodiment, has a plurality of squared portions 43, 45, 45.

The injector elements 36 have correspondingly squared openings 47 (FIG. 3), receiving the portions 45. Adjacent the portions 45, however, the shaft is round, and is journaled in bearings 40 (FIG. 3) mounted upon the top wall of bolt housing 49.

Figure 3:
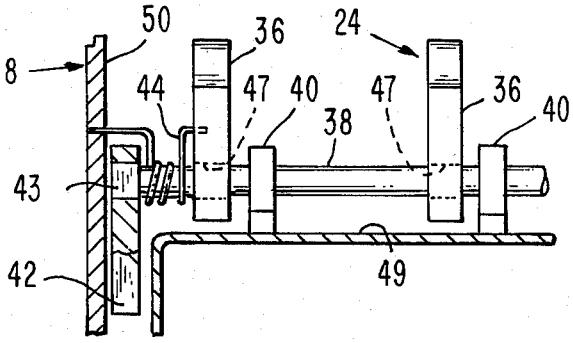
FIG. 3 is an enlarged, fragmentary transverse sectional view substantially on line 3—3 of FIG. 2.

Referring to FIGS. 1—3, an injector element actuating finger 42 has a square opening receiving the squared end portion 43 of the shaft 38, and is effective to rock the injector elements to their advanced, FIG. 1 positions.

For the purpose of maintaining the injector elements in normally retracted positions, there is provided a torsion spring 44 (FIG. 3), one end of which would be engaged with an adjacent injector element 36, while the other end is secured in side wall 50 of the firearm.

The Hill patents referred to above include, for the purpose of rotating the transfer disc 12, the disc actuator arm 16. In accordance with the present invention, there is integral or otherwise made rigid with said arm, a cam finger 46 extending from the actuating arm normally thereto.

The bolt of the weapon has been designated at 48, and is completely conventional, traveling forward to fire the round carried by transfer disc 12, when the round has been aligned longitudinally with the bore as in FIG. 2.

OPERATION

In use, and assuming that the magazine has been fully loaded, initially all the cartridges will be disposed in the magazine and the injector elements 36 will be in retracted positions. The lead cartridge will be engaged by the distal end portion 29, awaiting cross-feeding into the cartridge slot 14 of the transfer disc.

In these circumstances, retraction of arm 16 is effective to rotate the transfer disc to a position in which its slot 14 extends transversely of the bore, in position to receive the correspondingly transversely disposed lead cartridge, that is, the cartridge that is next to be fed into the breech and that is engaged against the distal end portion 29 of the flap 28.

Retraction of the arm 16 in the direction of the arrow shown in FIG. 1, is effective to cause the projection 46 to cammingly engage the distal end of the finger 42. As a result, finger 42 is biased counterclockwise as viewed in FIGS. 1 and 2, from its normal position shown in FIG. 2 to its position shown in FIG. 1.

The counterclockwise movement of the finger 42 is effective to advance the injector elements 36 through the slots 34, from their normally retracted, FIG. 2 positions. As described previously herein, the pointed portions 35 of the injector elements enter between the leading cartridge and the cartridge next following the same, so as to positively block passage of all cartridges from the magazine, except the leading cartridge. Also as previously noted herein, as the injector elements continue to move forwardly, the curved surfaces 39 thereof cammingly engage the cartridges that are to be restrained, as the injector elements move to their fully advanced positions shown in FIG. 1.

As the injector elements advance, the recesses 37 thereof receive the lead cartridge, and the lead cartridge is in this way forced downwardly, through the feed opening 33. Opening 33 expands to permit the cartridge to pass therethrough, by reason of the fact that the cartridge itself cammingly biases the distal end portion 29 outwardly, that is, to the right in FIG. 1, against the force of the torsion springs 32 provided on the hinge 30 used to connect the flap 28 to the top wall 26 of magazine 18.

Actuating arm 16 now moves forwardly, from the FIG. 1 to the FIG. 2 position thereof. This causes projection 46 to immediately disengage from finger 42, as a result of which the spring 44 is free to expand to retract the injector elements 36. The cartridge that was engaged by the cam surfaces 39 is now permitted, under the force of the follower spring 20, to move downwardly into engagement with the distal end portion 29. At the same time, the flap 28 will have moved back to its FIG. 2 position, reducing the size of opening 33, to a position sufficient to prevent passage of any cartridge through the opening 33. As previously noted, the force of the springs 32 is sufficient to overcome that of the follower spring 20 in these circumstances.

The forward movement of the actuating arm 16 is effective to rotate the disc 12 to the FIG. 2 position thereof, through 90° of angular travel, as a result of which the cartridge disposed in slot 14 aligns longitudinally with the bore of the firearm. Bolt 48 is now advanced and the round aligned with the bore is fired. The shell casing clears the breech in a manner described in the above-mentioned Hill patents, and the entire operation is repeated to force the next cartridge from the magazine into the slot of the transfer disc.

While the invention has been described in particular association with the transfer disc and actuating mechanism of the Hill patents, it is believed that the feed mechanism comprising the injector element assembly 24 and the associated flap 28, can be used in association with firing mechanisms other than those disclosed in the aforementioned Hill patents. For example, I am also aware of patents disclosing the crossfeeding of cartridges from magazines that extend parallel with the bore, such as the U.S. Pat. No. 2,448,081 to Conway, and U.S. Pat. No. 4,286,499 to Gillum. It is believed mainly important to note that the mechanism comprising the present invention can be readily correlated with or actuated by any of various firing mechanisms of firearms in which cartridges are cross-fed from a magazine, and in every instance the feed mechanism comprising the present invention will be effective to restrain or block passage of all cartridges that are not to be fed from the magazine, while at the same time exerting a positive force against the leading cartridge to feed the same through the feed opening of the magazine into the breech, so that it can be rotated to a firing position in alignment with the bore of the barrel of the gun.

Apart from the capability of the flap 28 for retaining the cartridges in the magazine 18 in the manner shown in FIG. 2, and yielding to permit passage of the leading cartridge C into the transfer disc 12 in the manner shown in FIG. 1, I incorporate another novel feature in the flap, which serves to limit the flap against accidental outward swinging movement from its FIG. 2 position, to an extent that would cause a quantity of the cartridges to drop from the magazine.

For example, the magazine may be of the type, as discussed previously herein, that is removable bodily from the firearm when emptied, for replacement by a like, fully loaded magazine. Military personnel, in this event, would very likely carry a quantity of fully loaded magazines in a magazine pouch. In these circumstances, it is not unreasonable to expect that in the field, the pouch is subject to heavy, jarring impacts. For example, this might very well be true in parachute drops.

In view of this possibility, the invention encompasses means for limiting accidental outward swinging movement of the flap 28. In the illustrated embodiment, this means is in the form of an offset flange or lip 52, formed integrally on flap 28 and extending above hinge 30 into closely spaced relation to the adjacent end of the magazine wall 26. Lip 52 does not engage wall 26 when the flap is opened to the limited extent shown in FIG. 1 to permit passage of a cartridge. If, however, magazines contained in a pouch or bag are subjected to a heavy impact, tending to open the flap 28 against the restraint of spring 32, lip 52 will engage wall 26, so that the flap will not open to an extent that will permit all or even a substantial quantity of the cartridges to spill from the magazine. Rather, the lip 52 will engage wall 26 after the flap opens, after which the force of the spring 32 will assert itself and tend to close the flap.

Other means might very possibly be used in place of the lip 52, so long as they will discharge the same function. For example, the flap might be equipped with a simple latch device which would keep it closed until it is mounted upon the firearm, at which time the act of mounting the magazine on the firearm may automaticaly disengage the latch. Alternatively, a simple latch may be provided, quickly and easily disengaged manually as part of the procedure of attaching a fresh magazine to the firearm.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a magazine and feed mechanism for a firearm having a receiver, a magazine mounted thereon and adapted to hold a plurality of cartridges arranged to be fed from the magazine in successively following order, a transfer disc rotatably mounted in the receiver and having a slot receiving the cartridge that is leading in the sense of the order in which the cartridges are fed from the magazine, in a position in which the leading cartridge initially extends transversely of the barrel and thereafter is alignable longitudinally therewith on rotatable movement of the disc, and a transfer disc actuating arm slidably movable in the receiver between a retracted position in which the disc receives the transversely disposed lead cartridge and an advanced position in which the arm rotates the disc to align the cartridge with the barrel, the improvement comprising:

(a) a flap on the magazine normally preventing feeding of the lead cartridge from the magazine to the disc;

(b) cartridge feed means movable between a normally retracted position and an advanced position in which it biases the lead cartridge past the flap and into the cartridge slot; and (c) means for biasing the feed means to its advanced position responsive to return movement of the actuating arm from its advanced to its retracted position.

2. In a magazine and feed mechanism for firearms the improvement of claim 1 wherein the flap is hingedly connected to the magazine for swinging movement between a first, normal position in which it restrains the lead cartridge from passage from the magazine to the disc, and a second position in which it yields to said passage.

3. In a magazine and feed mechanism for firearms the improvement of claim 2 in which the flap is under spring tension tending to bias the same to the first position thereof.

4. In a magazine and feed mechanism for firearms the improvement of claim 2 wherein the flap has an inturned distal end for engaging the lead cartridge, under the bias of the spring tension exerted against the flap, against passage into the cartridge slot of the disc in the first position of the flap.

5. In a magazine and feed mechanism for firearms the improvement of claim 3 wherein the feed means, when moved to its advanced position, exerts a force against the lead cartridge sufficient to overcome the spring tension and thereby bias the cartridge past the inturned end of the flap and into the slot of the transfer disc.

6. In a magazine and feed mechanism for firearms the improvement of claim 5 wherein the cartridge feed means includes at least one cartridge injector element entering the magazine when moved to its advanced position to exert a pressure against the leading cartridge effective to shift the cartridge into the slot of the transfer disc.

7. In a magazine and feed mechanism for firearms the improvement of claim 6 wherein the injector element is under spring bias tending to urge it to its normally retracted position.

8. In a magazine and feed mechanism for firearms the improvement of claim 7 wherein the injector element is pivotally mounted in the receiver for movement between its advanced and retracted positions.

9. In a magazine and feed mechanism for firearms the improvement of claim 8 wherein the means for biasing the cartridge feed means to its advanced position comprises an injector element shift member on the transfer disc actuating arm, the cartridge feed means further including a finger engageable by said member and connected to the injector element for swinging movement therewith, said member disengaging from the finger to free the injector element for movement to its retracted position when the arm is advanced to rotate the disc, and engaging the finger to bias the injector element to its advanced position when the arm is retracted.

10. In a magazine and feed mechanism for firearms the improvement of claim 9 wherein the injector element is in the form of a cam shaped to engage the lead cartridge and force it past the flap when the injector element is moved to its advanced position.

11. In a magazine and feed mechanism for firearms the improvement of claim 10 wherein the injector element shift member is in the form of a lateral projection on the transfer disc actuating arm, and wherein the finger is disposed in the path of the projection when the actuating arm is retracted to bias the cartridge injector element to its advanced position.

12. In a magazine and feed mechanism for firearms the improvement of claim 11 wherein the shift member exerts a cam action against the finger when the actuating arm is retracted.

13. In a magazine and feed mechanism for a firearm having a receiver, a magazine mounted thereon and adapted to hold a plurality of cartridges arranged to be fed from the magazine in successively following order, a transfer disc rotatably mounted in the receiver and having a slot receiving the cartridge that is leading in the sense of the order in which the cartridges are fed from the magazine, in a position in which the leading cartridge initially extends transversely of the barrel and thereafter is alignable longitudinally therewith on rotatable movement of the disc, and a transfer disc actuating arm slidably movable in the receiver between a retracted position in which the disc receives the transversely disposed lead cartridge and an advanced position in which the arm rotates the disc to align the cartridge with the barrel, the improvement comprising:

(a) gate means movably mounted on the magazine and normally engaging the leading cartridge against passage from the magazine into the cartridge slot of the transfer disc;

(b) cartridge injector means movable between a normally retracted position outside the magazine and an advanced position in which it passes the gate means to enter the magazine, engage the lead cartridge, and force the cartridge past the gate into the cartridge slot of the transfer disc; and (c) means on the transfer disc actuating arm for relating the movement of the injector means to the movement of the actuating arm, whereby the injector means will shift to its advanced position when the actuating arm is retracted, and to its retracted position when the actuating arm is advanced.

14. In a magazine and feed mechanism for firearms the improvement of claim 13 that further includes means limiting the movement of the gate means from its normal engagement with the leading cartridge.

15. In a magazine and feed mechanism for firearms the improvement of claim 14 wherein said means limiting movement of the gate means comprises a lip formed on the gate means and adapted to engage the magazine upon movement of the gate means from its position in normal engagement with the leading cartridge.

16. In a magazine and feed mechanism for firearms the improvement of claim 13 wherein the magazine extends forwardly from the transfer disc and has a rear end to which the gate means is connected.

17. In a magazine and feed mechanism for firearms the improvement of claim 16 in which the gate means is formed with at least one slot through which the cartridge injector means passes to enter the magazine.

18. In a magazine and feed mechanism for firearms the improvement of claim 17 wherein the injector means in its advanced position enters between the leading cartridge and the cartridge next following the same to restrain the next following cartridge while the leading cartridge is being forced past the gate means and into the cartridge slot of the transfer disc.

19. In a magazine and feed mechanism for firearms the improvement of claim 13 wherein the injector means includes a pivoted cam element for engaging the leading cartridge and a finger pivoting with the cam element, the means on the actuating arm including a member projecting laterally therefrom and cammingly biasing the finger when the arm is retracted, to shift the cam element into the magazine and thereby force the lead cartridge into the slot of the transfer disc.

* * * * *